United States Patent [19]

Davis

[11] Patent Number: 4,944,099

[45] Date of Patent: Jul. 31, 1990

[54] EXPANDABLE OUTSOLE

[75] Inventor: Howard Davis, New York, N.Y.

[73] Assignee: Slingshot Corporation, Palmer, Mass.

[21] Appl. No.: 238,614

[22] Filed: Aug. 30, 1988

[51] Int. Cl.[5] ..... A43B 3/26

[52] U.S. Cl. ..... 36/97; 36/102

[58] Field of Search ..... 36/12, 19 A, 19.5, 30 R, 36/31, 97, 102, 103, 11.5

[56] References Cited

U.S. PATENT DOCUMENTS

| | | | |
|---|---|---|---|
| 4,497 | 5/1846 | Vetter | 36/97 |
| 1,390,698 | 9/1921 | Golden | 36/126 |
| 1,607,896 | 11/1926 | Kelly | 36/22 R |
| 2,145,713 | 1/1939 | Damon | 36/19.5 |
| 2,252,315 | 8/1941 | Doree | 36/9 |
| 2,362,010 | 11/1944 | Huff | 36/2.5 |
| 2,590,648 | 3/1952 | Pitz | 36/11.5 |
| 3,086,301 | 4/1963 | Pastor | 36/2.5 |
| 4,505,055 | 3/1985 | Bergmans | 36/12 |
| 4,554,749 | 11/1985 | Ostrander | 36/102 |
| 4,628,936 | 12/1986 | Langer et al. | 128/614 |
| 4,642,911 | 2/1987 | Talarico | 36/30 R |
| 4,785,557 | 11/1988 | Kelley | 36/31 |

FOREIGN PATENT DOCUMENTS

| | | | |
|---|---|---|---|
| 597644 | 1/1933 | Fed. Rep. of Germany | 36/97 |
| 623016 | 3/1934 | Fed. Rep. of Germany | 36/97 |
| 1266620 | 6/1961 | France | 36/97 |

*Primary Examiner*—Werner H. Schroeder
*Assistant Examiner*—Diana L. Biefeld
*Attorney, Agent, or Firm*—Schechter, Brucker & Pavane

[57] ABSTRACT

An improved shoe outsole having an elastic shank (12) and suitable for outdoor wear, outsole portions (14,16) comprised of semi-rigid material for forming same, and a shoe (10) incorporating the improved outsole are disclosed. The front outsole portion (14) has a ledge (22) extending widthwise across the back end thereof and the rear outsole portion (16) has a ledge (24) extending widthwise across the front end thereof, such that the elastic shank (12) is joinable to the outsole portions (14,16) by means extending through the shank (12) and the ledges (22,24).

22 Claims, 3 Drawing Sheets

FIG. 1
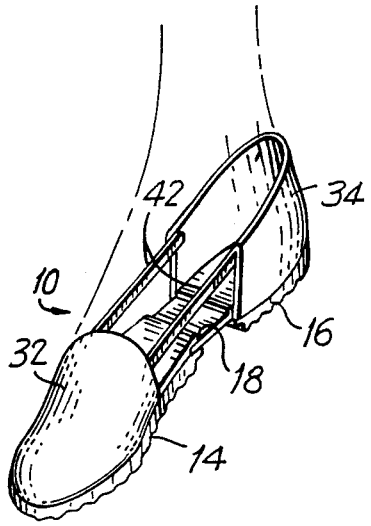
FIG. 2
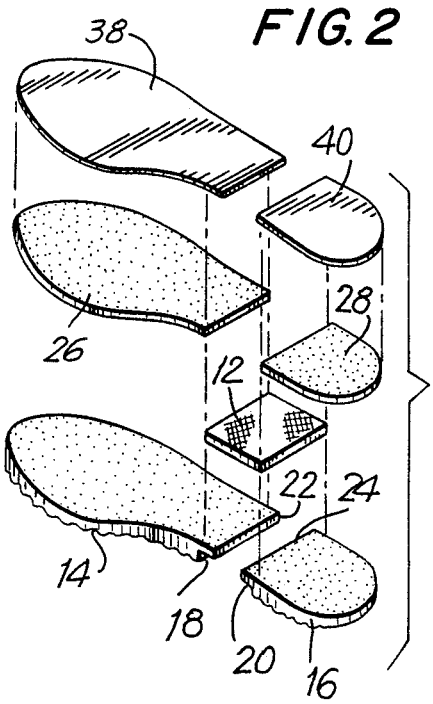
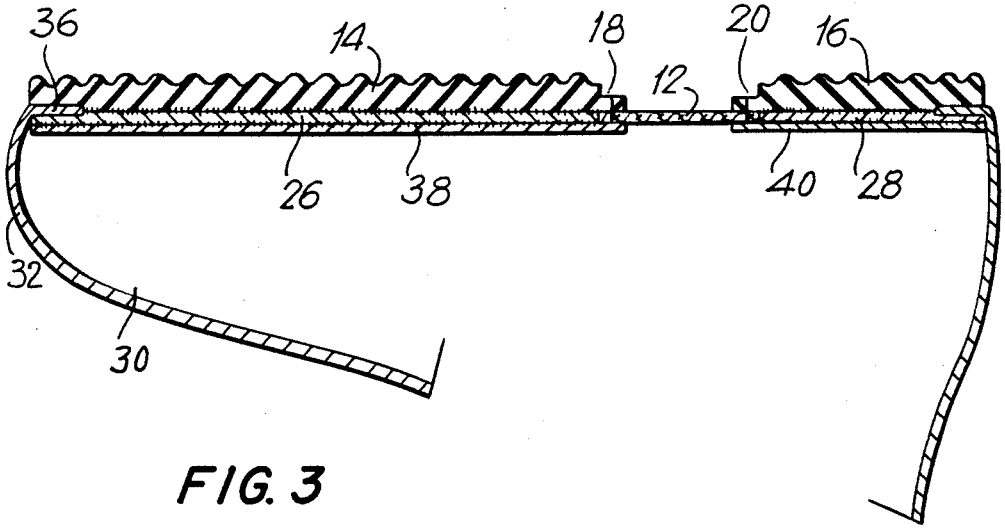
FIG. 3

FIG. 4
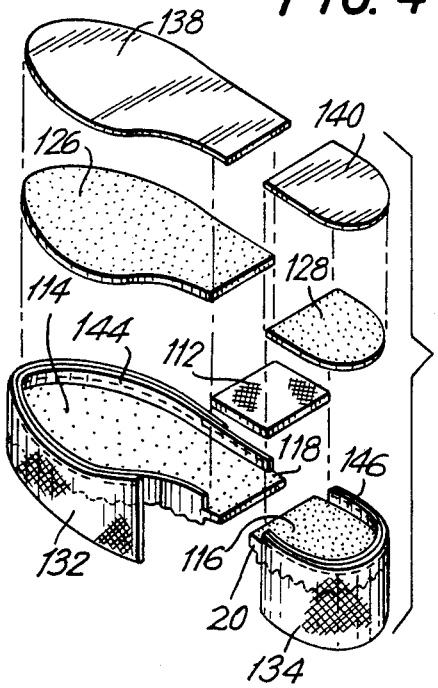
FIG. 5
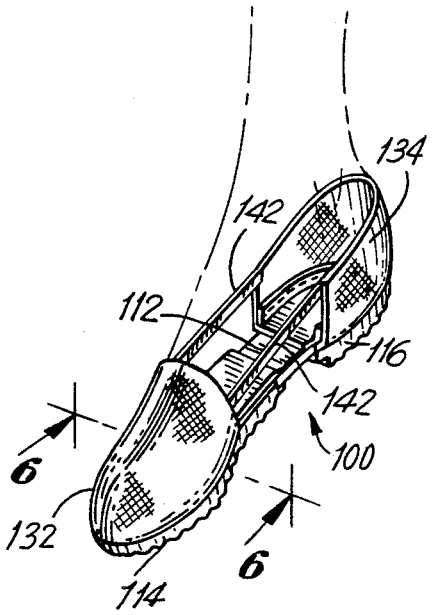
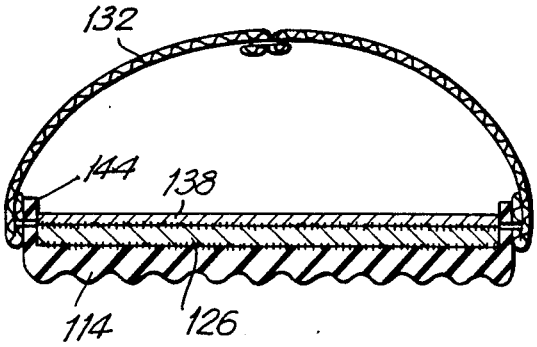
FIG. 6
FIG. 7
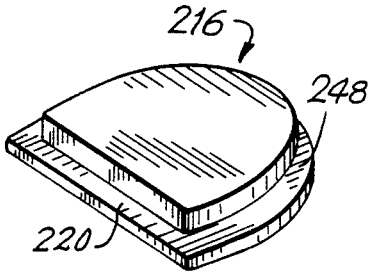

EXPANDABLE OUTSOLE

BACKGROUND OF THE INVENTION

1. Field of the Invention

This invention pertains to shoes, and more particularly to shoes suitable for outdoor walking and outsoles therefor.

2. Prior Art

Shoes intended for outdoor use have different construction requirements than those intended for indoor use. A primary difference is that outdoor shoes must have an outsole durable enough to last for a reasonable period of time on hard, outdoor surfaces, such as pavement. Indoor shoes, such as slippers, have no such requirement and, therefore, their outsoles can be constructed of a variety of soft, flexible materials. As a flexible outsole of the type found on slippers can readily conform to the foot as it moves, it is decidedly more comfortable than the more rigid outsoles found on outdoor shoes.

To provide a measure of flexibility to an outdoor shoe, U.S. Pat. No. 2,590,648 discloses a sandal comprised of three separate rigid sections joined by hinges. While this arrangement imparts some flexibility to what would otherwise be a rigid outsole, it does not permit stretching in the lengthwise direction and, as the outsole is preferably comprised of wood, it is probable that even with the hinged arrangment, the sandal is not very comfortable. A complex foot orthosis disclosing a similar hinged construction is disclosed in U.S. Pat. No. 4,628,936.

Another arrangement for improving the flexibility of an outdoor shoe is disclosed in U.S. Pat. No. 2,362,010 wherein the toe part of the shoe is joined to the heel part by an adjustable tongue and tape for allowing relative flexing motion between the toe and heel parts, and also for accommodating adjustments to the length of the shoe. However, once the length is adjusted, the distance between the toe and heel parts is fixed and, as a consequence, the outsole does not accommodate lengthwise stretching.

U.S. Pat. No. 3,086,301 discloses an outdoor shoe having an outsole defining a cut-out in the ball area, which cut-out is covered by a sheet of relatively flexible material. While this arrangement purports to increase the flexibility of the outsole and therefore the comfort thereof, it likewise does not accommodate stretching in the lengthwise direction. A somewhat similar construction incorporated, however, in the insole of a shoe, is disclosed in U.S. Pat. No. 1,607,896.

U.S. Pat. No. 1,390,698 discloses an athletic shoe incorporating a flexible shank section joined at its ends to relatively stiff toe and heel pieces, and joined to the upper by stitching. While this structure accommodate flexing at the shank, it too does not accommodate stretching in the lengthwise direction both because the shank is merely flexible, not elastic, and also because the stitching joining the shank to the upper would, in any event, block lengthwise stretching.

In indoor shoes, such as slippers, where there is no requirement for a durable outsole, and therefore construction requirements are greatly simplified, elastic shanks have been proposed. For example, such an arrangement is disclosed in U.S. Pat. No. 2,252,315 wherein an elastic shank is joined between a vamp and a heel or counter-portion, as by stitching. Because the front and rear outsole portions are formed of a flexible material, the assembly of such a shoe poses no construction problems, but, of course, the shoe cannot be worn outside, lest the outsole portions rapidly wear through. Another stretchable slipper is disclosed in U.S. Pat. No. 4,554,749 wherein the entire upper is comprised of an elastomeric fabric in which forward and rearward inner sole and outer sole sections are stitched, such that the natural elasticity of the upper, in the vicinity between the front and rear inner and outer sole sections, can stretch. Again, this construction is unsuitable for outdoor use, lest the front and rear outsole sections wear through. It also requires that the entire upper be comprised of an elastomeric material, which is not always desirable.

It is therefore an object of the present invention to provide an improved shoe suitable for outdoor wear which accommodates lengthwise stretching.

It is a further object of the invention to provide an improved outsole suitable for incorporation in the shoe of the present invention.

It is yet a further object of the present invention to provide front and rear outsole portions suitable for fabricating the outsole of the invention.

SUMMARY OF THE INVENTION

The present invention is for an improved shoe outsole having an elastic shank and suitable for outdoor wear, outsole portions comprised of semi-rigid material for forming same, and a shoe incorporating the improved outsole. The front and rear outsole portions have confronting widthwise ledges so that the elastic shank is joinable to the front and rear outsole portions by means, such as stitching, extending through the shank and the ledges.

In one aspect, the invention comprises a shoe outsole suitable for outdoor wear comprising a front outsole portion comprised of a semi-rigid material suitable for outdoor use, the front outsole portion having a ledge extending widthwise across the back end thereof; a rear outsole portion comprised of a semi-rigid material suitable for outdoor use, the rear outsole portion having a ledge extending widthwise across the front end thereof; and an elastic shank extending between the front and rear outsole portions, and means extending through shank and the ledges for joining the shank to the outsole portions.

The invention also comprises a shoe suitable for outdoor wear comprising a front outsole portion comprised of a semi-rigid material suitable for outdoor use, the front outsole portion having a ledge extending widthwise across the back end thereof; a rear outsole portion comprised of a semi-rigid material suitable for outdoor use, the rear outsole portion having a ledge extending widthwise across the front end thereof; an elastic shank extending between the front and rear outsole portions, and means extending through the shank and the ledges for joining the shank to the outsole portions for defining therewith the outsole of the shoe; and an upper comprising vamp and heel portions joined at their bottom edges to the peripheries of said front and rear outsole portions, respectively.

The invention also comprises front and rear outsole portions for forming an outsole suitable for outdoor wear comprising a front outsole portion comprised of a semi-rigid material suitable for outdoor use, the front outsole portion having a ledge extending widthwise across the back end thereof; and a rear outsole portion comprised of a semi-rigid material suitable for outdoor use, the rear outsole portion having a ledge extending widthwise across the front end thereof; whereby an elastic shank may be joined to the front and rear outsole portions by means extending through the shank and the ledges for forming a stretchable outsole suitable for outdoor use.

Further features and advantages of the shoe outsole, shoe, and front and rear outsole portions in accordance with the present invention will be more fully apparent from the following detailed decription and annexed drawings of the presently preferred embodiments thereof.

BRIEF DESCRIPTION OF THE DRAWINGS

In the drawings:

FIG. 1 is a perspective view of a preferred shoe in accordance with the present invention;

FIG. 2 is an exploded view of the shoe of FIG. 1, showing construction of the sole;

FIG. 3 is a sectional view showing another step in the construction of the shoe of FIG. 1;

FIG. 4 is an exploded perspective view showing construction of another shoe in accordance with the present invention;

FIG. 5 is a perspective view of the shoe of FIG. 4;

FIG. 6 is a sectional view taken substantially along the lines 6——6 in FIG. 5; and FIG. 7 is a perspective view of a modified heel for constructing yet another preferred shoe in accordance with the invention;

DETAILED DESCRIPTION OF THE PREFERRED EMBODIMENTS

Figure 8:
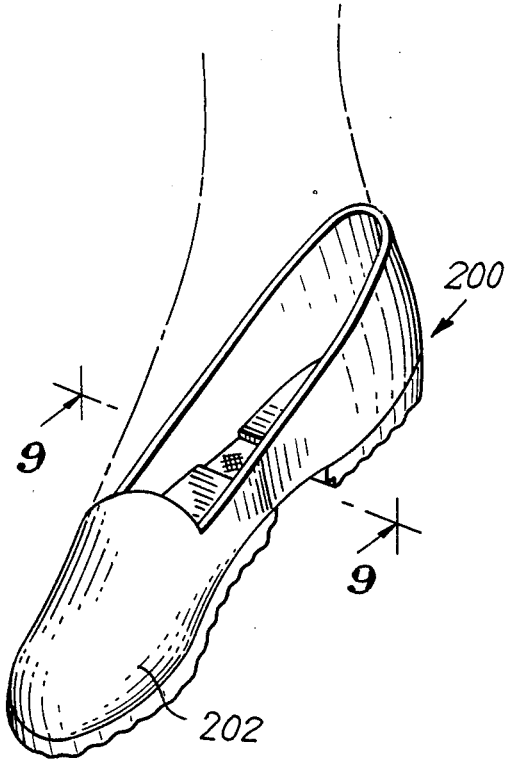
FIG. 8 is a perspective view of an alternate embodiment illustrating a shoe having a unitary upper.

Referring now to the drawings, and initially to FIG. 1 thereof, a preferred shoe in accordance with the present invention is generally designated at 10. Like all the shoes in accordance with the present invention, the shoe 10 has an elastic shank 12 joining the front and rear outsole portions 14 and 16, respectively, such that during walking the shank stretches and contracts with the natural movements of the foot, thereby providing a stylish yet comfortable shoe.

An important feature of the invention is the construction of the front and rear outsole portions 14 and 16, and the manner in which they are secured to the shank 12 for providing a durable shoe. Referring to FIGS. 1–3, the front and rear outsole portions 14 and 16 are planar and may be formed with roughened or corrugated bottom surfaces to facilitate traction. As shown, the confronting ends of the outsole portions 14, 16 are formed with bottom cutouts 18, 20, respectively, for defining confronting ledges 22, 24. To provide the durability required for a walking shoe, as contrasted with a slipper which is typically only worn about the house, the outsole portions 14, 16 comprise a semi-rigid material, meaning one which can flex, but which will have a useful life during normal outdoor usage. Exemplary of this class of materials are rubber and various synthetics which simulate rubber, with EVA being presently preferred.

To assemble the shoe 10, the shank 12 is first joined to the outsole portions 14, 16 by placing the ends of the shank 12 over the ledges 22, 24 and then stitching through the shank and the ledges. The stitching must be through the ledges, as the full thickness of the outsole portions 14, 16 is simply too thick to stitch through. Also, if the stitching went through the full thickness of the outsole portions 14, 16, the stitching at the bottom of the outsole portions would contact the ground, and as the shoe 10 is intended for outdoor wear, such stitching would quickly wear through. While the shank may be stitched to the topsides or undersides of the ledges 22, 24, as preferred and shown the shank is stitched to the topsides of the ledges.

After the outsole assembly comprising the outsole portions 14, 16 and shank 12 is stitched, the front and rear insole parts 26, 28, which may comprise urethane, are tacked to a last 30 with their topsides confronting the last. The bottoms of the insole parts 26, 28 are then coated with an adhesive. Thereafter, the bottom edge of the upper, comprising vamp and heel portions 32, 34, respectively, are coated with adhesive whereupon the vamp 32 and heel 34 are wrapped about the last 30 in a manner well known to those of ordinary skill in the art such that the bottom edge 36 of the upper extends about the periphery of the insole parts 26, 28. The tacks securing the insole parts 26, 28 to the last 30 are then removed. The upper may comprise a wide variety of materials, though cloth is presently preferred.

The topside of the outsole assembly is next coated with adhesive, except that no adhesive is applied to the shank 12, whereupon the outsole assembly is spotted by hand to the insole parts 26, 28, such that the edge 36 of the upper is sandwiched between the outsole portions 14, 16 and the insole parts 26, 28. The assembly is then subjected to a sole laying machine which, by pressure, bonds the outsole, upper and insole together. As best seen in FIG. 3, the insole parts 26, 28 are dimensioned to overlie the front and rear outsole portions 14, 16, respectively, without, however, overlying the shank 12. As a consequence, the insole parts 26, 28 and the shank 12 collectively define a comfortable, planar surface for the foot of the wearer.

With the shoe now removed from the last 30, a liner, comprising front and rear liner parts 38, 40 is secured, as by an adhesive, to the upper surfaces of the insole parts 26, 28. As shown in FIG. 3, the liner parts 38, 40 are dimensioned to overlie the insole parts 26, 28 and to also overlie the edges of the shank 12 to hide the stitching. However, the liner does not completely overlie the shank 12 lest it interfere with the elasticity thereof. Even though the liner does not cover the shank, this is not perceptible to the wearer, both because the liner is very thin and the shank is confronted by the arch of the foot. The liner may comprise, for example, thin cloth. While it is preferred and shown that the liner completely overlies the insole parts 26, 28, this is not necessary, and the liner could overlie only a portion thereof, the primary purpose of the liner being to cover the stitching securing the shank 12 to the outsole portions 14, 16. If desired, the name of the manufacturer, a logo and/or a shoe size may be imprinted on the topside of the liner for viewing by purchasers.

Assembly of the shoe 10 is completely by stitching or otherwise securing the elastic strips 42 to the vamp 32 and heel 34 such that the elastic strips extend therebetween. While the elastic strips are included primarily for aesthetic reasons, they also serve to keep the vamp 32 and heel 34 form collapsing when not in use.

In use, the shank 12 stretches as the heel is raised from the ground at the initiation of a step, and contracts as the foot is lifted from the ground as the step is completed. This expansion and contraction of the shank 12 with the natural motion of the foot, which also prevents the vamp 32 and heel 34 from binding to the foot during walking, has been found to be quite comfortable for the wearer. In accordance with the shoe construction described hereinabove, the comfort of the shoe 10 is achieved in a highly durable construction, thanks primarily to the structure of the outsole assembly comprising the outsole portions 14, 16 and shank 12, and particularly the use of the ledges 18, 20 which allow the front and heel outsole portions to be relatively thick while still allowing the shank to be stitched thereto.

In a modified form of the shoe 10, a one piece upper is used, providing a closed shank or pump type shoe. Assembly of a pump is essentially the same as that described above, except that when adhesive is applied to the bottom edge of the upper, no adhesive is applied in the vicinity of the shank. Consequently, when the shoe is removed form the last 30, the edge of the upper is not secured to the shank 12. Securement is accomplished by stitching the shank 12 to the upper using elastic thread, such that during walking the shank portion of the upper is free to stretch with the shank 12. However, if the upper is itself stretchable, it may be glued to the shank rather than stitched.

Referring now to FIGS. 4–6, another preferred shoe in accordance with the present invention is generally designated at 100. Like the shoe 10 and all the shoes in accordance with the present invention, the shoe 100 comprises an elastic shank 112 and semi-rigid front and rear outsole portions 114 and 116, respectively, the latter defining ledges 118 and 120 dimensioned for stitching to shank 112. Unlike the shoe 10, however, and as best seen in FIGS. 4 and 6, the outsole portions 114 and 116 have upturned edges 144 and 146, respectively. As will be explained below, these edges permit the shoe 100 to be assembled without a last and in less steps than the shoe 10.

Because EVA is not suitable for molding with an upturned edge, the outsole portions 114 and 116 are formed of rubber, or of rubber and EVA bonded together, in which event the rubber outsole portions are first molded with an upturned edge and then joined to EVA bottoms, as by an adhesive, though, of course, if a process is perfected for forming EVA or some equivalent material with an upturned edge, the outsole may be formed integrally from such material. Regardless of which construction is employed, the bottom of the outsole portions 114 and 116 are preferably corrugated for increased traction.

To assemble the shoe 100, the bottom edge of the two part upper, comprising a vamp 132 and a heel 134, is first stitched, preferably on a post stitching machine (not shown), to the upturned edges 144, 146 of the outsole portions 114, 116, which are spaced apart a distance sufficient to accommodate the shank 112. The upper is stitched inside out (FIG. 4) after which the upper is pulled upward about its bottom edge such that the bottom edge defines an inside hem for hiding the stitching from view (FIG. 6). This procedure is also followed for a one part upper for constructing a pump type shoe, though of course stitching is interrupted along the bottom edge of the upper extending across the space reserved for the shank 112.

Next, the shank 112 is stitched to the ledges 118, 120 of the outsole portions 114 and 116, respectively. If a one piece upper is employed, the bottom edge of the upper in the vicinity of the shank is stitched to the shank by elastic thread, though here too, if the upper is stretchable, it may be glued to the shank. Thereafter, the front and rear insole parts 126, 128 are secured, as by an adhesive, to the outsole portions 114, 116, respectively. As in the case of the shoe 10, the insole parts 126, 128 collectively define, with the shank 112, a planar surface suitable for contact with the wearer's foot.

Next, the liner parts 138, 140 are secured, again as by an adhesive to the insole such that the stitching joining the shank 112 to the outsole is covered, and this comprises the final assembly step for the pump type shoe. For the two part upper shown in the drawings, the final assembly step comprises securing the elastic bands 142 to the vamp and heel portions of the upper.

From the foregoing description, those of ordinary skill in the art will appreciate that still further changes and modifications may be made in the shoe in accordance with the present invention. By way of example, a modified outsole heel portion is shown in FIG. 7 and designated at 216. The heel portion 216 is similar to the heel 16 of FIGS. 1–3, except that in addition to the ledge 220, the heel portion 216 includes a peripheral ledge 248 extending completely about the heel. The front portion of the outsole (not shown) is similarity formed, i.e. it too has a peripheral ledge extending completely thereabout.

Figure 9:
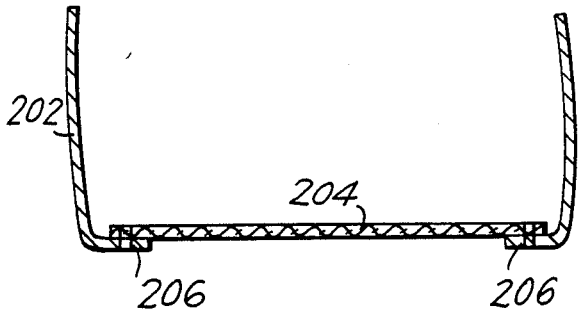
FIG. 9 is a cross-sectional view taken substantially along line 9—9 of FIG. 8.

FIGS. 8 and 9 illustrates an alternate embodiment wherein shoe 200 has a unitary upper 202. FIG. 9 is a cross-sectional view illustrating upper 202 secured to shank 204 by elastic thread 206.

To assemble a shoe incorporating the heel portion 216 and the corresponding front outsole portion, initially, the bottom edge of the upper, whether one part or two, is stitched, as on a post stitching machine, to the top of the peripheral ledges of the heel and front outsole portions, which are spaced apart a distance sufficient to accommodate the shank. Assembly of the shoe is completed by following the assembly steps outlined above for the shoe 100 of FIGS. 4–6. It will by now be apparent that a shoe constructed in this fashion has all the advantages of the shoes 10 and 100 described above, i.e. it is comfortable to wear and yet sufficiently durable to withstand walking on pavement and other outside surfaces.

While I have herein shown and described the preferred embodiments of the outsole in accordance with the present invention and of shoes constructed therewith, and have also suggested certain modifications thereto, it will be apparent to those of ordinary skill in the art that still further changes and modifications may be made therein without departing from the spirit and scope of the invention. Accordingly, the above description should be construed as illustrative, and not in a limiting sense, the scope of the invention being defined by the following claims.

I claim:

1. A shoe outsole suitable for outdoor wear comprising:

a front outsole portion comprised of a semi-rigid material suitable for outdoor use, said front outsole portion having a ledge extending widthwise across the back end thereof;

a rear outsole portion comprised of a semi-rigid material suitable for outdoor use, said rear outsole portion having a ledge extending widthwise across the front end thereof wherein said ledges of the front and rear outsole portions extend upwardly away from the bottom of the front and rear outsole portions so that the ledges do not contact the ground; and an elastic shank extending between said front and rear outsole portions, and means extending through said shank and said ledges for joining said shank to said outsole portions.

2. The shoe outsole according to claim 1, wherein said joining means comprises stitching.

3. The shoe outsole according to claim 2, wherein the ends of said elastic shank overlie the tops of said ledges.

4. The shoe outsole according to claim 1, wherein said semi-rigid material comprises EVA.

5. The shoe outsole according to claim 1, wherein said semi-rigid material comprises rubber.

6. The shoe outsole according to claim 1, wherein said front and rear outsole portions have upturned peripheral edges extending thereabout for facilitating joining of an upper thereto.

7. The shoe outsole according to claim 1, wherein said front and rear outsole portions have peripheral ledges extending thereabout for facilitating joining of an upper thereto.

8. A shoe suitable for outdoor wear comprising:

a front outsole portion comprised of a semi-rigid material suitable for outdoor use, said front outsole portion having a ledge extending widthwise across the back end thereof;

a rear outsole portion comprised of a semi-rigid material suitable for outdoor use, said rear outsole portion having a ledge extending widthwise across the front end thereof wherein said ledges of the front and rear outsole portions extend upwardly away from the bottom of the front and rear outsole portions so that the ledges do not contact the ground;

an elastic shank extending between said front and rear outsole portions, and means extending through said shank and said ledges for joining said shank to said outsole portions for defining therewith the outsole of said shoe; and an upper comprising vamp and heel portions joined at their bottom edges to the peripheries of said front and rear outsole portions, respectively.

9. The shoe according to claim 8, further comprising elastic members on either side of said shoe joining said vamp and heel portions of said upper in the shank region thereof.

10. The shoe according to claim 8, wherein said vamp and heel portions of said upper are formed as a single unit for also extending across the shank region of said shoe, and further comprising means for securing said upper to said elastic shank.

11. The shoe according to claim 8, wherein the shank region of the upper comprises elastic material.

12. The shoe according to claim 10, wherein the securing means comprises elastic thread.

13. The shoe according to claim 8, wherein the bottom edges of said vamp and heel portions of said upper are joined to said peripheries of said outsole portions by an adhesive.

14. The shoe according to claim 8, wherein said front and rear outsole portions have upturned peripheral edges extending thereabout, and wherein said bottom edges of said vamp and heel portions of said upper are stitched to said upturned peripheral edges.

15. The shoe according to claim 8, wherein front and rear outsole portions have peripheral ledges extending thereabout, and wherein said bottom edges of said vamp and heel portions of said upper are stitched to said peripheral ledges.

16. The shoe according to claim 8, wherein the ends of said elastic shank overlie the tops of said ledges, and further comprising an insole having front and rear portions joined to the tops of said front and rear outsole portions, respectively, for collectively defining, with said elastic shank, a substantially planar surface.

17. The shoe according to claim 16, further comprising a liner overlying at least said joining means extending through said ledges and said elastic shank.

18. Front and rear sole portions for forming an outsole suitable for outdoor wear comprising;

a front outsole portion comprised of a semi-rigid material suitable for outdoor use, said front outsole portion having a ledge extending widthwise across the bank end thereof; and a rear outsole portion comprised of a semi-rigid material suitable for outdoor use, said rear outsole portion having a ledge extending widthwise across the front end thereof wherein said ledges of the front and rear outsole portions extend upwardly away from the bottom of the front and rear outsole portions so that the ledges do not contact the ground;

whereby an elastic shank may be joined to said front and rear outsole portions by means extending through said shank and said ledges for forming a stretchable outsole suitable for outdoor use.

19. The outsole portions according to claim 18, wherein said semi-rigid material comprises EVA.

20. The outsole portions according to claim 19, wherein said semi-rigid material comprises rubber.

21. The outsole portions according to claim 19, wherein said front and rear outsole portions have upturned peripheral edges extending thereabout for facilitating joining of an upper thereto.

22. The shoe according to claim 19, wherein said front and rear outsole portions have peripheral ledges extending thereabout for facilitating joining of an upper thereto.

* * * * *